US011479445B2

(12) United States Patent
Jagdale et al.

(10) Patent No.: US 11,479,445 B2
(45) Date of Patent: Oct. 25, 2022

(54) ELEVATOR CAR SYSTEM AND METHOD FOR MOUNTING AN ELEVATOR CAR ROOF COMPRISING AT LEAST ONE TOE BOARD TO UPRIGHTS

(71) Applicant: Inventio AG, Hergiswil (CH)

(72) Inventors: Swapnil Jagdale, Maharashtra (IN); Rahul Devtale, Maharashtra (IN)

(73) Assignee: INVENTIO AG, Hergiswil (CH)

( * ) Notice: Subject to any disclaimer, the term of this patent is extended or adjusted under 35 U.S.C. 154(b) by 10 days.

(21) Appl. No.: 16/764,013

(22) PCT Filed: Dec. 6, 2018

(86) PCT No.: PCT/EP2018/083711
§ 371 (c)(1),
(2) Date: May 14, 2020

(87) PCT Pub. No.: WO2019/115319
PCT Pub. Date: Jun. 20, 2019

(65) Prior Publication Data

US 2020/0331726 A1 Oct. 22, 2020

(30) Foreign Application Priority Data

Dec. 13, 2017 (EP) ..... 17207014

(51) Int. Cl.
*B66B 11/02* (2006.01)

(52) U.S. Cl.
CPC ..... *B66B 11/0226* (2013.01); *B66B 11/0206* (2013.01)

(58) Field of Classification Search
CPC ..... B66B 11/0226; B66B 11/0206
See application file for complete search history.

(56) References Cited

U.S. PATENT DOCUMENTS 3,374,915 A * 3/1968 Verhein ..... B65D 88/528 220/4.28
4,357,993 A * 11/1982 Halpern ..... B66B 11/0253 187/401

(Continued)

FOREIGN PATENT DOCUMENTS

AU 599118 B2 1/1988
CN 1248217 A 3/2000

(Continued)

OTHER PUBLICATIONS

Ning, Li, Elevator Car, Aug. 10, 2016, Machine translation of CN 205442341 U (Year: 2016).*

*Primary Examiner* — Michael R Mansen
*Assistant Examiner* — Michelle M Lantrip
(74) *Attorney, Agent, or Firm* — William J. Clemens; Shumaker, Loop & Kendrick, LLP

(57) ABSTRACT

An elevator car roof includes two toe boards for mounting the elevator car roof at a mounting position to uprights of an elevator car. Each of the toe boards has projecting brackets for holding the elevator car roof at the uprights in the mounting position. Each of the uprights includes a slot for receiving one of the projecting brackets when the elevator car roof is held in the mounting position by the uprights. The projecting brackets and the slots can be formed to prevent a wrong orientation of the elevator car roof relative to the uprights.

10 Claims, 3 Drawing Sheets

(56) References Cited

U.S. PATENT DOCUMENTS

| | | | | | |
|---|---|---|---|---|---|
| 4,635,756 | A | | 1/1987 | Sherwood et al. | |
| 4,700,809 | A | * | 10/1987 | Lazar | B66B 11/0253 187/401 |
| 5,975,249 | A | | 11/1999 | Tomaseti | |
| 6,209,686 | B1 | * | 4/2001 | Tomasetti | B66B 11/0226 187/401 |
| 2007/0181383 | A1 | * | 8/2007 | Bizarria Santos | B66B 11/0253 187/401 |
| 2011/0100763 | A1 | * | 5/2011 | Wiacek | B66B 11/0253 187/401 |
| 2015/0175388 | A1 | * | 6/2015 | Klappholz | B66B 11/0226 187/401 |
| 2017/0137261 | A1 | | 5/2017 | Maruyama | |

FOREIGN PATENT DOCUMENTS

| | | | | | |
|---|---|---|---|---|---|
| CN | 201512335 | U | | 6/2010 | |
| CN | 101948064 | A | * | 1/2011 | |
| CN | 201834634 | U | * | 5/2011 | |
| CN | 102092622 | A | * | 6/2011 | |
| CN | 102190232 | A | * | 9/2011 | |
| CN | 202193520 | U | * | 4/2012 | |
| CN | 203095355 | U | * | 7/2013 | |
| CN | 203372959 | U | * | 1/2014 | |
| CN | 203699610 | U | | 7/2014 | |
| CN | 203715035 | U | * | 7/2014 | E04B 9/247 |
| CN | 104326341 | A | * | 2/2015 | B66B 11/0253 |
| CN | 205442341 | U | | 8/2016 | |
| CN | 206126595 | U | | 4/2017 | |
| CN | 106794965 | A | | 5/2017 | |
| DE | 8528810 | U1 | | 1/1986 | |
| EP | 1657206 | A2 | | 5/2006 | |
| FR | 2588542 | B1 | | 1/1990 | |
| JP | H10101280 | A | | 4/1998 | |
| JP | 2011001151 | A | * | 1/2011 | |
| WO | WO-9723401 | A1 | * | 7/1997 | E04B 9/247 |
| WO | 9839242 | A1 | | 9/1998 | |
| WO | WO-2018099939 | A2 | * | 6/2018 | B66B 11/0253 |

* cited by examiner

ELEVATOR CAR SYSTEM AND METHOD FOR MOUNTING AN ELEVATOR CAR ROOF COMPRISING AT LEAST ONE TOE BOARD TO UPRIGHTS

FIELD

The present invention relates to an elevator car system and a method for mounting an elevator car roof comprising at least one toe board to uprights.

BACKGROUND

Usually, an elevator car roof is mounted to uprights wherein the uprights are mounted to an elevator car base plate, i.e., the base of the elevator car. For this, the elevator car roof is moved into a mounting position by a lifting device and held in the mounting position by the lifting device, wherein the elevator car roof is in a set distance from the elevator car base plate. Then, while the elevator car roof is held in the mounting position, the elevator car roof is mounted to the uprights, e.g., by nuts and/or bolts.

One disadvantage of this is that the lifting device needs to hold the elevator car roof exactly in the mounting position while the mounting of the elevator car roof to the uprights is carried out. Furthermore, one disadvantage of this is that the mounting of the elevator car roof to the uprights takes a lot of time. Also, the lifting device is needed while the mounting of the elevator car roof to the uprights is carried out. In addition, it is possible that the holding device budges while mounting the elevator car roof to the uprights and the elevator car roof falls in the direction of the elevator car base plate. Also, the elevator car roof has to be held precisely at the mounting position and no movement of the elevator car roof should take place.

There may be a need for an elevator car system and a method for mounting an elevator car roof comprising at least one toe board to uprights, respectively, which can be mounted technically easily and in short amount of time to uprights of an elevator car base plate or with which an elevator car roof can be mounted technically easily and in a short amount of time to uprights of an elevator car base plate, respectively.

SUMMARY

According to an aspect of the present invention, an elevator car system is proposed comprising an elevator car base plate, uprights mounted to the elevator car base plate, and an elevator car roof as described above, wherein each of the uprights comprises a slot for receiving one projecting bracket such that when the projecting brackets are positioned in the slots the elevator car roof is held in the mounting position by the uprights. One advantage hereof is that, usually, the elevator car roof does not have to be held by a holding device while the elevator car roof is mounted to the uprights. Typically, by this, the elevator car system can be assembled, i.e., the elevator car roof can be mounted to the uprights, in a short amount of time and very safely. Furthermore, the mounting position is achieved automatically when the elevator car roof is held by the projecting brackets, normally. Thus, usually, the elevator car roof can be mounted to the uprights in a short amount of time. Also, generally, safety is increased since there is no danger that the elevator car roof can fall down during the mounting. In addition, usually, the elevator car roof does not move relative to the uprights during the mounting which accelerates the mounting of the elevator car roof to the uprights.

The elevator car roof comprises at least one toe board, in particular two toe boards, for mounting the elevator car roof to uprights of the elevator car at a mounting position of the elevator car roof, wherein the toe board, in particular each toe board, comprises projecting brackets for holding the elevator car roof at the uprights in the mounting position. One advantage hereof is that, typically, the elevator car roof does not have to be held by a holding device while the elevator car roof is mounted to the uprights. Usually, this simplifies the mounting. Furthermore, the mounting position is achieved automatically when the elevator car roof is held by the projecting brackets, in general. Thus, typically, the elevator car roof can be mounted to the uprights in a short amount of time. Also, generally, safety is increased since there is no danger that the elevator car roof can fall down during the mounting. In addition, usually, the elevator car roof does not move relative to the uprights during the mounting which accelerates the mounting of the elevator car roof to the uprights.

According to an aspect of the present invention, a method for mounting an elevator car roof comprising at least one toe board, in particular two toe boards, to uprights wherein the uprights are mounted to an elevator car base plate is proposed, wherein the method comprises the following steps: — lowering the elevator car roof in the direction of the elevator car base plate such that projecting brackets of the toe board of the elevator car roof are inserted into slots of the uprights until the elevator car roof reaches a mounting position in which the brackets—hinder a further lowering of the elevator car roof in the direction of the elevator car base plate and—hold the elevator car roof in the mounting position; and —mounting the elevator car roof to the uprights. One advantage hereof is that the elevator car roof can be mounted to the uprights technically easily, in general. In particular, usually, no holding device for holding the elevator car roof is needed while the elevator car roof is mounted to the uprights. Furthermore, typically, the method can be carried out in a short amount of time since the elevator car roof cannot move relative to the uprights while mounting. Also, in general, the elevator car roof reaches and stays at the mounting position automatically when the elevator car roof is held by the projecting brackets. In addition, typically, safety is increased with this method since the elevator car roof is held securely by the projecting brackets and cannot fall down.

Ideas underlying embodiments of the present invention may be interpreted as being based, inter alia, on the following observations and recognitions.

According to an embodiment, the brackets are arranged symmetrically to a center axis of the elevator car roof. By this, typically, the forces are distributed equally across the elevator car roof and among the uprights. Thus, each projecting bracket has to carry only a small part of the weight of the elevator car roof and can be adapted technically easily and can be low-priced, in general.

According to an embodiment, each of the toe boards comprises two, in particular exactly two, projecting brackets. One advantage hereof is that the elevator car roof is held by four uprights, in particular all uprights, of the elevator car, in general. Typically, this increases the safety during mounting.

According to an embodiment of the elevator car system, the slots are formed correspondingly to the brackets, respectively. Typically, by this, a tight fit between the projecting brackets and the slots is achieved. This way, there is no or little allowance for clearance, in general. This decreases the amount of time for mounting the elevator car roof to the uprights, usually.

According to an embodiment of the elevator car system, the brackets and the slots are formed such that tops of the uprights are flush with an upper edge of the toe board, in particular with the upper edges of both toe boards, when the elevator car roof is in the mounting position. Typically, one advantage hereof is that it can be checked by a quick view by looking perpendicular to the uprights or with a touch if the elevator car roof has been moved in the mounting position. In general, this increases the safety since it can be determined quickly if the elevator car roof is in the mounting position or not.

According to an embodiment of the elevator car system, the projecting brackets and the slots are formed individually such that the elevator car roof can be brought into the mounting position in only one orientation of the elevator car roof relative to the uprights. In general, by this, the orientation of the elevator car roof is determined technically easily. Bringing the elevator car roof in the mounting position while the orientation of the elevator car roof is not correct is not possible due to the form, i.e., shape and/or size, of the brackets and the slots, typically. Usually, this reduces the amount of time needed to mount the elevator car roof to the uprights in the desired orientation of the elevator car roof relative to the uprights and/or the elevator car base plate.

According to an embodiment of the method, the elevator car roof is mounted to the uprights by mounting the toe board of the elevator car roof to the uprights. Typically, by this, the elevator car roof is mounted to the uprights technically easily.

According to an embodiment of the method, tops of the uprights are flush with an upper edge of the toe board, in particular with the upper edges of both toe boards, when the elevator car roof has been moved in the mounting position. Typically, one advantage hereof is that it can be checked by a quick view by looking perpendicular to the uprights or with a touch if the elevator car roof is in the mounting position. Usually, this increases the safety since it can be determined quickly if the elevator car roof is in the mounting position or not.

It shall be noted that features and advantages of embodiments of the invention are described herein partly with respect to an elevator car roof for an elevator car, partly with respect to an elevator car system comprising such elevator car roof and partly with respect to a method for mounting an elevator car roof comprising at least one toe board to uprights. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawings. However, neither the drawings nor the description shall be interpreted as limiting the invention. The figures are only schematic and not to scale. Same reference signs refer to same or similar features.

DETAILED DESCRIPTION

Figure 1:
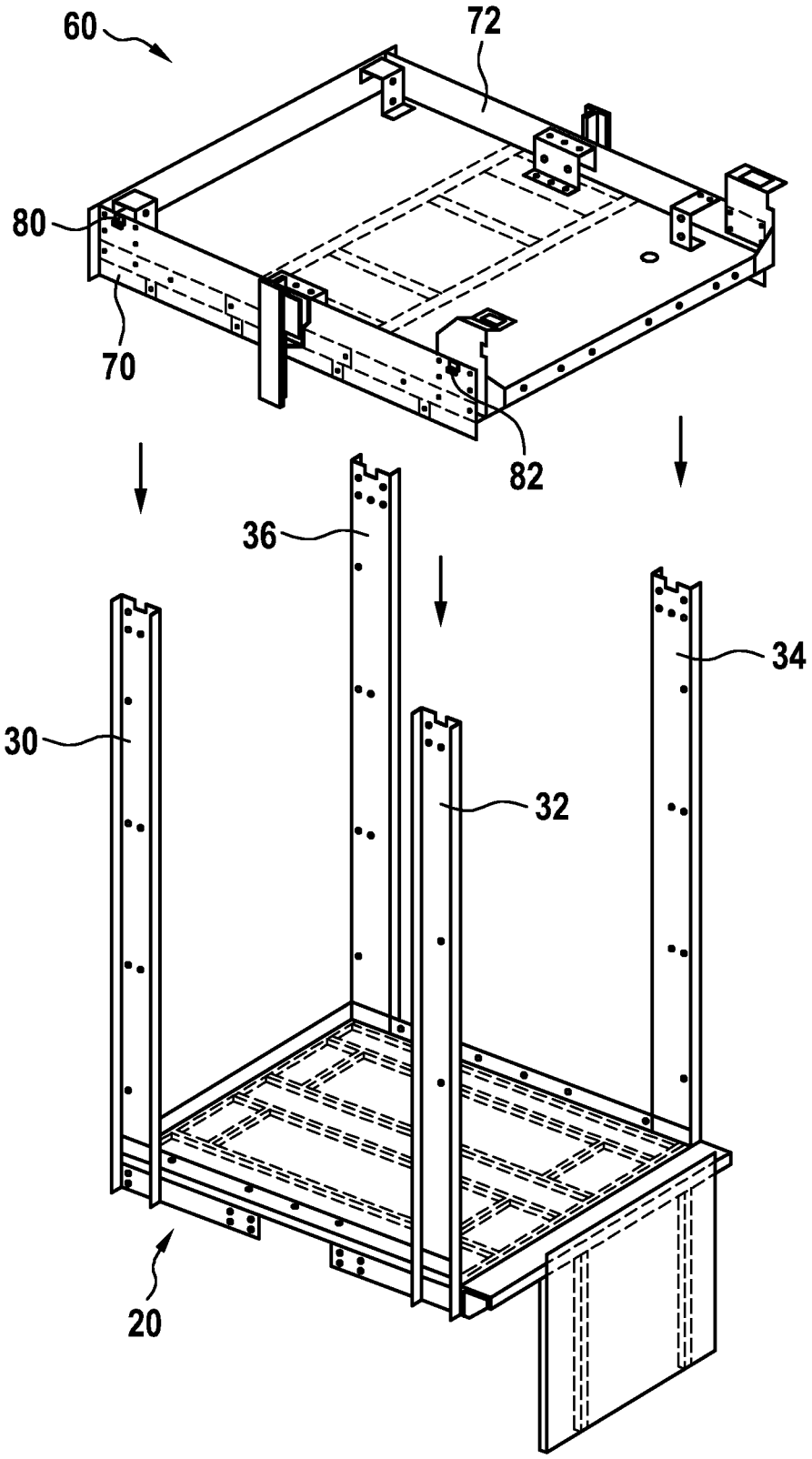
FIG. 1 shows an embodiment of an elevator car system according to the present invention in a perspective view.

FIG. 1 shows an embodiment of an elevator car system according to the present invention. The elevator car system comprises an elevator car base plate 20 which is the ground or base of the elevator car 10. Four uprights 30, 32, 34, 36 at or near the corners of the elevator car base plate 20 are mounted to the elevator car base plate 20. As indicated by arrows in FIG. 1 the elevator car roof 60 is moved on top of the uprights 30, 32, 34, 36, i.e., the elevator car roof 60 is lowered onto the uprights 30, 32, 34, 36.

Figure 2:
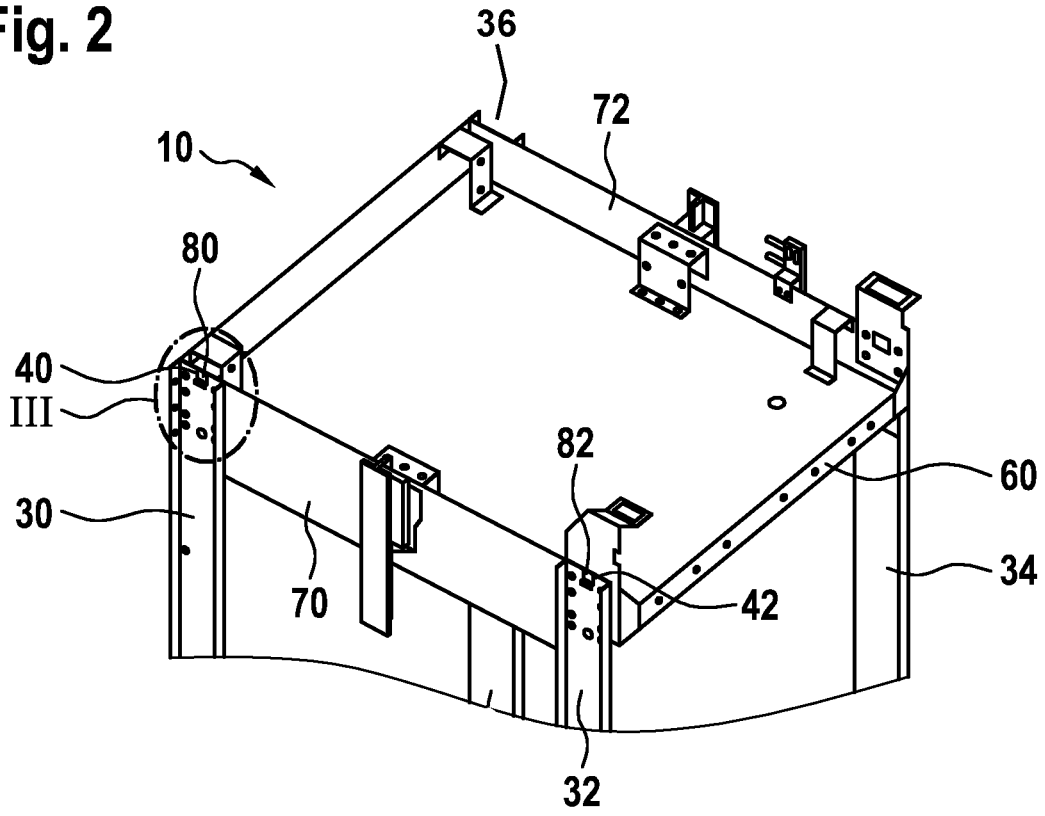
FIG. 2 shows an elevator car system according to the present invention in a perspective view having the elevator car roof mounted to the uprights.
Figure 3:
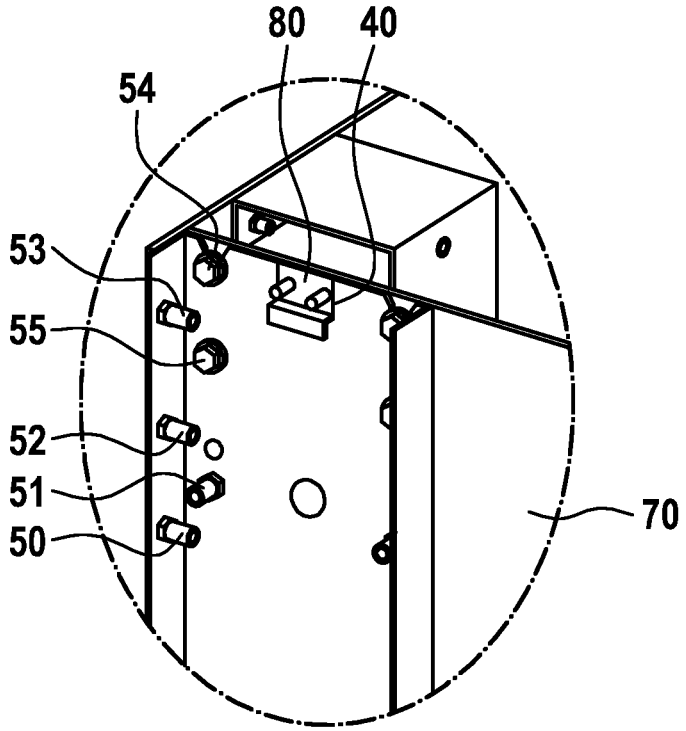
FIG. 3 shows an enlarged detailed view of the section III of FIG. 2.

FIG. 2 shows an embodiment of the elevator car roof 60 according to the present invention mounted to the uprights 30, 32, 34, 36. FIG. 3 shows a detailed view of the section III of FIG. 2.

The elevator car roof 60 comprises two toe boards 70, 72 which are positioned parallel to the uprights 30, 32, 34, 36 (in particular to an outer surface of the uprights 30, 32, 34, 36) in the mounted state of the elevator car roof 60 (shown in FIG. 2), respectively. Two projecting brackets 80, 82 are mounted at each toe board 70, 72 or can be part of each of the two boards. I.e., the elevator car roof 60 has exactly four projecting brackets 80, 82. The number of projecting brackets 80, 82 can be higher (e.g., five, six or seven brackets) or lower (e.g., two or three brackets).

The projecting brackets 80, 82 are mounted to the toe board 70, 72 near its upper corners (in the mounting position). The projecting brackets 80, 82 project to an outer side of the toe board 70, 72, respectively. Each projecting bracket 80, 82 has a hook-like form which is open to the bottom, i.e., in the direction of the elevator car base plate 20 in the mounting position of the elevator car roof 60.

The projecting bracket 80, 82 has an upper section which runs essentially parallel to the outer surface of the toe board 70, 72 and parallel to the uprights 30, 32, 34, 36. Then, in the direction from the top of the elevator car 10 to the bottom of the elevator car 10, a first bent section follows immediately adjacent to the upper section.

Immediately adjacent to the first bent section, a mid section of the projecting bracket 80, 82 runs essentially perpendicularly to the outer surface of the outer board, perpendicularly to the upper section of the projecting bracket 80, 82 and perpendicularly the uprights 30, 32, 34, 36. Immediately adjacent to the mid section, a second bent section follows. Finally, at the bottom of the projecting bracket 80, 82, immediately adjacent to the second bent section, a lower section of the projecting bracket 80, 82 runs essentially parallel to the upper section, parallel to the outer surface of the toe board 70, 72 and parallel to the uprights 30, 32, 34, 36.

The lower section of the projecting bracket 80, 82 has a distance, in particular a distance of a few centimeters, e.g., ca. 1 cm to ca. 5 cm, to the outer surface of the toe board 70, 72. The width of the projecting bracket 80, 82 is the same along the different sections. The form of the brackets 80, 82 in a top view perpendicular to an outer surface of the toe boards 70, 72, respectively, is rectangular. The projecting bracket 80, 82 is mounted to the toe board 70, 72 via two fixing elements in the upper section.

The uprights 30, 32, 34, 36 connect the elevator car base plate 20 with the elevator car roof 60 and hold the elevator car roof 60. Each upright 30, 32, 34, 36 of the elevator car 10 has a slot 40, 42 at the top, which is farthest away from the elevator car base plate 20, of the upright 30, 32, 34, 36. The slot 40, 42 is a notch or a furrow of the upright 30, 32, 34, 36. The slots 40, 42 are adapted for receiving the projecting bracket 80, 82. Each slot 40, 42 receives exactly one projecting bracket 80, 82.

The elevator car roof 60 is lowered onto the uprights 30, 32, 34, 36, which all have the same heights (i.e., the top of the uprights 30, 32, 34, 36 have the same distance to the elevator car base plate 20), such that the projecting brackets 80, 82 are received by the slots 40, 42 of the uprights 30, 32, 34, 36. The brackets 80, 82 are inserted into the slots 40, 42. The lowering of the elevator car roof 60 can be done with a holding device. The projecting brackets 80, 82 come into contact with the inner surface of the slots 40, 42 (the lower surface of the slot 40, 42), wherein the lower sections of the projecting brackets 80, 82 are on the outer side of the uprights 30, 32, 34, 36 while the inner side of the uprights 30, 32, 34, 36 are close to the toe board 70, 72 or in contact with the toe board 70, 72. I.e., a part of the upright 30, 32, 34, 36 is located between the lower section of the bracket 80, 82 and the toe board 70, 72 when the elevator car roof 60 is in the mounting position.

The slot 40, 42 has a depth, wherein the depth runs from top to bottom of the elevator car 10 (i.e., essentially from top to bottom in FIG. 1), such that a top edge of the toe board 70, 72 lies flush with the top of the upright 30, 32, 34, 36, when the elevator car roof 60 is in the mounting position. This applies to all four uprights 30, 32, 34, 36. The mounting position of the elevator car roof 60 is shown in FIG. 2 and FIG. 3, respectively. In the mounting position the elevator car roof 60 is in a set distance from the elevator car base plate 20 and is positioned essentially parallel to the elevator car base plate 20.

Figure 4:
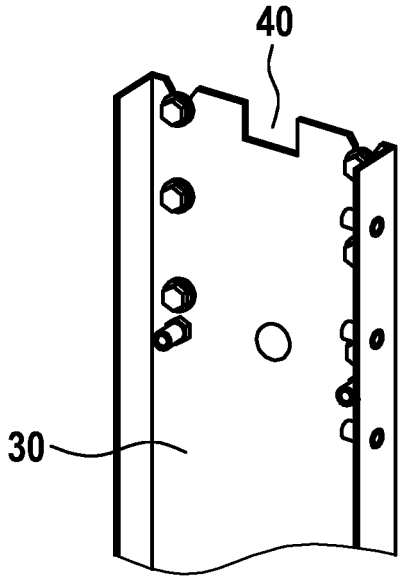
FIG. 4 shows a detailed view of one of the uprights of FIG. 1 and FIG. 2.
Figure 5:
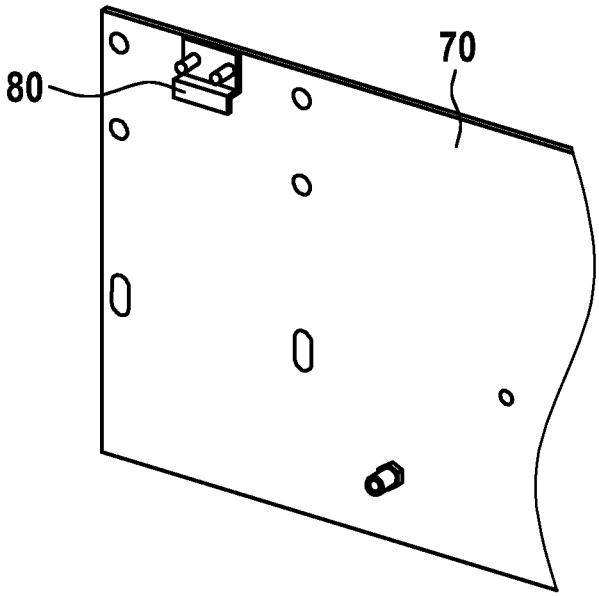
FIG. 5 shows a detailed view of the toe board with one of the projecting brackets of FIG. 1, FIG. 2 and FIG. 3, respectively.

FIG. 4 shows a detailed view of one of the uprights 30 of FIG. 1 and FIG. 2. FIG. 5 shows a detailed view of the toe board 70 with one of the projecting brackets 80 of FIG. 1, FIG. 2 and FIG. 3, respectively.

The elevator car roof 60 is mounted to the uprights 30, 32, 34, 36 as follows: First, four uprights 30, 32, 34, 36 are mounted to an elevator car base plate 20. Then, the elevator car roof 60 is lowered onto the four uprights 30, 32, 34, 36, indicated by arrows in FIG. 1. The projecting brackets 80, 82 of the elevator car roof 60 are received in the slots 40, 42 of the uprights 30, 32, 34, 36 during lowering of the elevator car roof 60. A part of the upright 30, 32, 34, 36 is received between the lower sections of the projecting brackets 80, 82 and the toe boards 70, 72, respectively.

Finally, the projecting brackets 80, 82 (in particular the mid section of the projecting bracket 80, 82) hinder a further downward movement of the elevator car roof 60 towards the elevator car base plate 20, i.e., the projecting brackets 80, 82 come into contact with the inner surface of the slots 40, 42. Now, the elevator car roof 60 is in the mounting position. In the mounting position, the device which was used for holding and lowering the elevator car roof 60 is no longer needed. The elevator car roof 60 is held securely in the mounting position by the uprights 30, 32, 34, 36.

Then, when the elevator car roof 60 is in the mounting position, the elevator car roof 60 is mounted to the uprights 30, 32, 34, 36 via mounting elements 50-55. The mounting elements 51, 54, 55 are also shown in FIG. 4, even though the toe board 70, 72 is not shown in FIG. 4.

In the mounting position, the mounting elements 50-55, e.g., bolts, are inserted through openings and/or cavities of the uprights 30, 32, 34, 36 and corresponding openings/cavities in the toe board 70, 72. Thus, the elevator car roof 60 is fixedly mounted to the uprights 30, 32, 34, 36 and, thus, to the elevator car base plate 20. The toe board 70, 72 is mounted to the uprights 30, 32, 34, 36 and, thus, the elevator car roof 60 is mounted to the uprights 30, 32, 34, 36.

The length of the slot 40, 42, wherein the length runs along the top edge of the toe board 70, 72, is essentially the same as the length of the projecting bracket 80, 82. By this, the lateral position of the elevator car roof 60 is also fixed when the elevator car roof 60 is in the mounting position, i.e., the elevator car roof 60 is held by the projecting brackets 80, 82 which are inside the slots 40, 42 of the uprights 30, 32, 34, 36. The projecting brackets 80, 82 are arranged symmetrically around a center axis of the elevator car roof 60, wherein the center axis of the elevator car roof 60 runs through the center of the elevator car roof 60 and parallel to the uprights 30, 32, 34, 36 from top to bottom of the elevator car 10. The form of the slots 40, 42 of the uprights 30, 32, 34, 36 can be identical to each other. The form of the projecting brackets 80, 82 can be identical to each other.

Alternatively, the projecting brackets 80, 82 and the slots 40, 42 can be formed individually such that the projecting brackets 80, 82 can be received only in one orientation of the elevator car roof 60 relative to the uprights 30, 32, 34, 36. This means that the slots 40 are not formed identically to each other and the slots 42 are not formed identically to each other. For example, the slot 40 on the front left upright 30 in FIG. 1 is formed correspondingly to the front left front projecting bracket 80 in FIG. 1. However, if the elevator car roof 60 is turned by 180° around a center axis of the elevator car roof 60 (i.e., parallel to the elevator car base plate 20), wherein the center axis runs from top to bottom and through the center of the elevator roof, the projecting bracket 80 which is now the front left projecting bracket 80 (the projecting bracket 80 on the back right in FIG. 1, which cannot be seen in FIG. 1) does not fit into the slot 40 of the front left upright 30 in FIG. 1. The same applies to the front right projecting bracket 82 and the slot 42 of the front right upright 32 in FIG. 1. I.e., the right front projecting bracket 82 fits into the slot 42 of the right front upright 32 in FIG. 1 in the orientation of the elevator car roof 60 shown in FIG. 1. However, if the elevator car roof 60 is turned around the center axis of the elevator car roof 60 by 180° which moves the back left projecting bracket 82 of FIG. 1 to the position of the front right projecting bracket 82 and moves the front right projecting bracket 82 of FIG. 1 to the back left projecting bracket 82, the projecting brackets 80, 82 do not fit into the slots 40, 42 of the uprights 30, 32, 34, 36.

It is possible that the slot 40 of the front left upright 30 and the slot 42 of the back left upright 36 are formed identically to each other, since the elevator car roof 60 cannot be brought into a position that the front left projecting bracket 80 should be moved into the slot of the back left upright 36 by turning the elevator car roof 60 around the center axis. Also, the slot of the back right upright 34 and the slot 42 of the front right upright 32 can be formed identically since the elevator car roof 60 cannot be brought into a position that the back right projecting bracket 80 should be moved into the slot 42 of the front right upright 32 by turning the elevator car roof 60 around the center axis.

By these different forms of the projecting brackets 80, 82 and slots 40, 42, the lowering of the elevator car roof 60 into a mounting position wherein the elevator car roof 60 has an orientation which is turned by 180° around the center axis of the elevator car roof 60 relative to a desired/planned orientation is not possible. Thus, mounting the elevator car roof 60 in a wrong/not desired orientation to the uprights 30, 32, 34, 36 (relative to the uprights 30, 32, 34, 36 and/or the elevator car base plate 20) is not possible, since the form of the projecting brackets 80, 82 and the slots 40, 42 hinder bringing the elevator car roof 60 in a mounting position wherein the elevator car roof 60 has the wrong orientation relative to the uprights 30, 32, 34, 36.

E.g., the lengths of the projecting bracket 80, 82 (the length runs parallel to the top edge of the toe board 70, 72) and the slots 40, 42 can be different. Thus, if the orientation of the elevator car roof 60 is wrong, the projecting bracket 80, 82 does not fit into the (wrong) slot 40, 42 since the slot 40, 42 has a smaller length than the projecting bracket 80, 82. Thus, it is sufficient if only one of the slots 40, 42 and one of the projecting brackets 80, 82 is formed differently than the others.

The two toe boards are arranged parallel to each other at opposite sides of the elevator car roof 60. The slots 40, 42 have a rectangular form when viewed perpendicularly to the respective outer surface of the toe boards 70, 72.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for mounting an elevator car roof having two toe boards to a plurality of uprights mounted to an elevator car base plate, the method comprising the steps of:

providing the toe boards with projecting brackets and providing the uprights with slots at a top end thereof, where each of the projecting brackets has a first section mounted flush to an outer side of the toe board, a second section extending substantially perpendicularly away from the toe board, and a third section extending downward;

lowering the elevator car roof toward the elevator car base plate such that the projecting brackets of the toe boards are inserted into the slots of the uprights until the elevator car roof reaches a mounting position in which the projecting brackets cooperate with the slots to hinder a further lowering of the elevator car roof toward the elevator car base plate;

holding the elevator car roof in the mounting position; and mounting the elevator car roof to the uprights.

2. The method according to claim 1 including mounting the elevator car roof to the uprights by mounting the toe boards to the uprights.

3. The method according to claim 1 including checking that tops of the uprights are flush with an upper edge of each of the toe boards before mounting the elevator car roof to the uprights.

4. An elevator car system comprising:

an elevator car base plate;

a plurality of uprights mounted to the elevator car base plate;

an elevator car roof having a toe board for mounting the elevator car roof to the uprights at a mounting position of the elevator car roof;

wherein the toe board includes at least one projecting bracket for holding the elevator car roof at the uprights in the mounting position, where the at least one projecting bracket has a first section mounted flush to an outer side of the toe board, a second section extending substantially perpendicularly away from the toe board, and a third section extending downward; and wherein one of the uprights has a slot formed at a top end therein for receiving the at least one projecting bracket such that when the at least one projecting bracket is positioned in the slot the elevator car roof is held in the mounting position by the uprights.

5. The elevator car system according to claim 4 wherein the toe board includes two of the at least one projecting bracket and two of the uprights each have the slot formed therein, each of the slots receiving one of the two projecting brackets to hold the elevator car roof in the mounting position.

6. The elevator car system according to claim 5 wherein the elevator car roof has another toe board, the another toe board including two of the projecting brackets, and including four of the uprights each having the slot formed therein, each of the slots receiving one of the projecting brackets to hold the elevator car roof in the mounting position.

7. The elevator car system according to claim 6 wherein the projecting brackets are arranged symmetrically to a center axis of the elevator car roof.

8. The elevator car system according to claim 6 wherein the slots are formed correspondingly to the projecting brackets received therein.

9. The elevator car system according to claim 6 wherein the projecting brackets and the slots are formed such that tops of the uprights are flush with an upper edge of each of the toe boards when the elevator car roof is in the mounting position.

10. The elevator car system according to claim 6 wherein the projecting brackets and the slots are formed individually such that the elevator car roof can be brought into the mounting position in only one orientation of the elevator car roof relative to the uprights.

* * * * *